US011059292B2

(12) United States Patent
Tsuzuki et al.

(10) Patent No.: US 11,059,292 B2
(45) Date of Patent: Jul. 13, 2021

(54) HEAD DIAPHRAGM SUBSTRATE, LIQUID DISCHARGE HEAD, LIQUID DISCHARGE DEVICE, AND LIQUID DISCHARGE APPARATUS

(71) Applicants: Kohei Tsuzuki, Kanagawa (JP); Takashi Mori, Kanagawa (JP); Ryoji Okamoto, Kanagawa (JP); Yuta Hiratsuka, Kanagawa (JP); Kaname Morita, Kanagawa (JP); Yohsuke Kobayashi, Kanagawa (JP)

(72) Inventors: Kohei Tsuzuki, Kanagawa (JP); Takashi Mori, Kanagawa (JP); Ryoji Okamoto, Kanagawa (JP); Yuta Hiratsuka, Kanagawa (JP); Kaname Morita, Kanagawa (JP); Yohsuke Kobayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/293,722

(22) Filed: Mar. 6, 2019

(65) Prior Publication Data

US 2019/0283423 A1 Sep. 19, 2019

(30) Foreign Application Priority Data

Mar. 14, 2018 (JP) ..... JP2018-046271

(51) Int. Cl.
*B41J 2/14* (2006.01)
*B41J 25/00* (2006.01)

(52) U.S. Cl.
CPC ..... *B41J 2/14233* (2013.01); *B41J 25/006* (2013.01)

(58) Field of Classification Search
None
See application file for complete search history.

(56) References Cited

U.S. PATENT DOCUMENTS 6,303,218 B1 * 10/2001 Kamiguchi ..... B82Y 10/00 360/313
2007/0106962 A1 5/2007 Sakakibara et al.
2007/0115323 A1 5/2007 Mori
2007/0242107 A1 10/2007 Mori
2007/0247492 A1 10/2007 Mori
2008/0043069 A1 * 2/2008 Shimada ..... H01L 41/0973 347/72
2009/0033704 A1 2/2009 Mori
2010/0053269 A1 3/2010 Fujii et al.
2010/0109488 A1 * 5/2010 Doellgast ..... H01L 41/187 310/366

(Continued)

FOREIGN PATENT DOCUMENTS

JP 5-287576 11/1993
JP 10-264400 10/1998

(Continued)

*Primary Examiner* — Erica S Lin
(74) *Attorney, Agent, or Firm* — Oblon, McClelland, Maier & Neustadt, L.L.P.

(57) ABSTRACT

A metal member includes a first layer and a second layer. The second layer has an average crystal grain size different from an average crystal grain size of the first layer. An intermediate layer having an average crystal grain size smaller than the average crystal grain sizes of the first layer and the second layer is interposed between the first layer and the second layer.

18 Claims, 10 Drawing Sheets

(56) References Cited

U.S. PATENT DOCUMENTS

| | | | | |
|---|---|---|---|---|
| 2010/0231631 | A1 | 9/2010 | Hosaka | |
| 2013/0241990 | A1 | 9/2013 | Shimoda et al. | |
| 2014/0368582 | A1* | 12/2014 | Nakao ..... | B41J 2/161<br>347/68 |
| 2014/0375725 | A1 | 12/2014 | Sameshima et al. | |
| 2017/0066237 | A1 | 3/2017 | Katagiri et al. | |

FOREIGN PATENT DOCUMENTS

| | | |
|---|---|---|
| JP | 2006-216204 | 8/2006 |
| JP | 2010-179631 | 8/2010 |
| JP | 2011-224971 | 11/2011 |
| JP | 2013-193296 | 9/2013 |
| JP | 2014-071069 | 4/2014 |

* cited by examiner

HEAD DIAPHRAGM SUBSTRATE, LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-046271, filed on Mar. 14, 2018, in the Japan Patent Office, the entire disclosure of which is incorporated by reference herein.

BACKGROUND

Technical Field

The present disclosure relates to a head diaphragm substrate, a liquid discharge head, a liquid discharge device, and a liquid discharge apparatus.

Related Art

Conventionally, to suppress warpage of a metal member formed by electroforming, it has been known that an average grain size of a first electroformed film is different from an average grain size of a second electroformed film.

SUMMARY

In an aspect of the present disclosure, there is provided a metal member that includes a first layer and a second layer. The second layer has an average crystal grain size different from an average crystal grain size of the first layer. An intermediate layer having an average crystal grain size smaller than the average crystal grain sizes of the first layer and the second layer is interposed between the first layer and the second layer.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
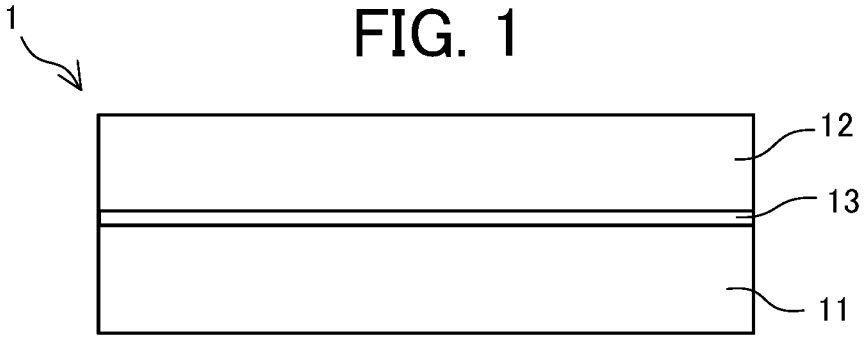
FIG. 1 is an explanatory view of a metal member according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
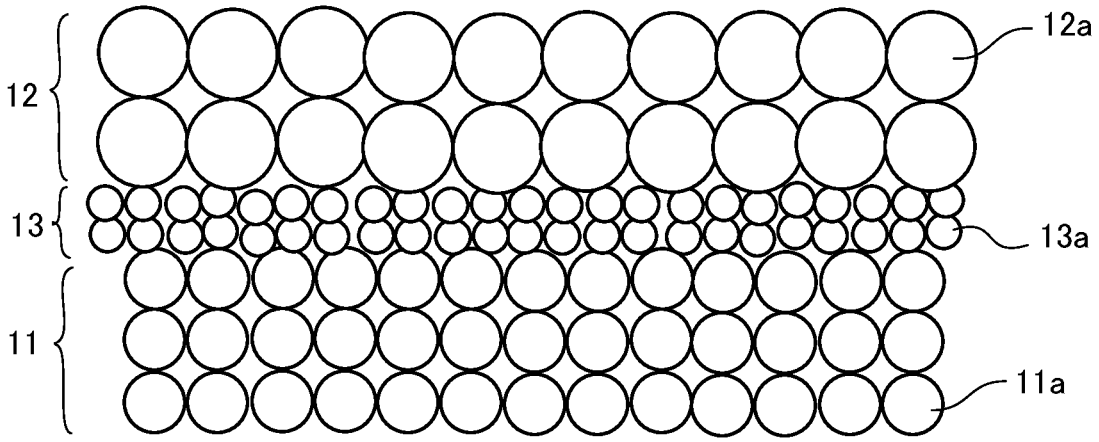
FIG. 2 is a schematic explanatory view of layers of the metal member.

An embodiment of the present disclosure will be described below with reference to the accompanying drawings. A first embodiment of the present disclosure will be described referring to FIGS. 1 and 2. FIG. 1 is an explanatory view of a metal member according to the first embodiment, and FIG. 2 is a schematic explanatory view of layers of the metal member.

A metal member 1 includes a first layer 11 and a second layer 12 having an average crystal grain size different from an average crystal grain size of the first layer 11, and an intermediate layer 13 having an average crystal grain size smaller than the average crystal grain sizes of the first layer 11 and the second layer 12 is interposed between the first layer 11 and the second layer 12.

In the present embodiment, an average crystal grain size of a crystal grain 12*a* of the second layer 12 is larger than an average crystal grain size of a crystal grain 11*a* of the first layer 11, and an average crystal grain size of a crystal grain 13*a* of the intermediate layer 13 is smaller than the average crystal grain size of the crystal grain 11*a* of the first layer 11.

Therefore, for example, when the second layer 12 is formed after the first layer 11 has been formed or when the first layer 11 is formed after the second layer 12 has been formed, the intermediate layer 13 having the average crystal grain size smaller than the average crystal grain sizes of the first layer 11 and the second layer 12 is interposed between the first layer 11 and the second layer 12.

With this structure, while warpage caused by a difference between the grain sizes of the first layer 11 and the second layer 12 is suppressed, the small crystal grains 13*a* of the intermediate layer 13 easily enter between the crystal grains 11*a* of the first layer 11 and between the crystal grains 12*a* of the second layer 12 so as to improve adhesion, and a delamination can be reduced.

Here, a method for confirming the crystal grain size may be, for example, to observe a cross section in a thickness direction by a Scanning Electron Microscope (SEM) or a Transmission Electron Microscope (TEM) or to analyze the cross section through electron backscattered diffraction (EBSD). By performing these analysis on a region of about one μm on an interface between the first layer 11 and the intermediate layer 13 and an interface between the intermediate layer 13 and the second layer 12, the crystal grain size can be confirmed.

Figure 3:
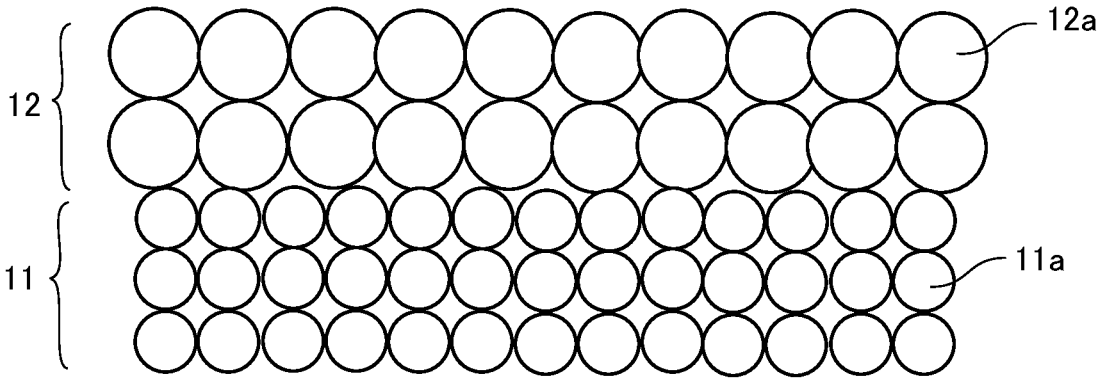
FIG. 3 is a schematic explanatory view of layers of a metal member according to a comparative example 1.

Here, a comparative example 1 will be described referring to FIG. 3. FIG. 3 is a schematic explanatory view of the comparative example 1.

In the comparative example 1, the second layer 12 is formed on the first layer 11 without providing the intermediate layer 13 in the present embodiment.

In the comparative example 1, for example, in a case where the second layer 12 having a large average crystal grain size is formed on the first layer 11 having a small average crystal grain size, the crystal grain 12*a* of the second layer 12 cannot enter between the crystal grains 11*a* of the first layer 11. Therefore, the adhesion between the first layer 11 and the second layer 12 is not sufficient. In a case where, for example, a head diaphragm substrate includes the metal member in the comparative example 1, the delamination easily occurs due to repeated displacement.

On the other hand, since the metal member 1 according to the present embodiment has high interlayer adhesion, in a case where the head diaphragm substrate includes the metal member 1, the delamination due to the repeated displacement hardly occurs.

Next, control of the crystal grain size according to the present embodiment will be described referring to FIGS. 4A to 5B. FIGS. 4A to 5B are profiles having different current densities provided for explaining the control of the crystal grain size.

In a case where the metal member 1 is formed by electroforming, the crystal grain size can be easily controlled by controlling the current density.

Figure 4A:
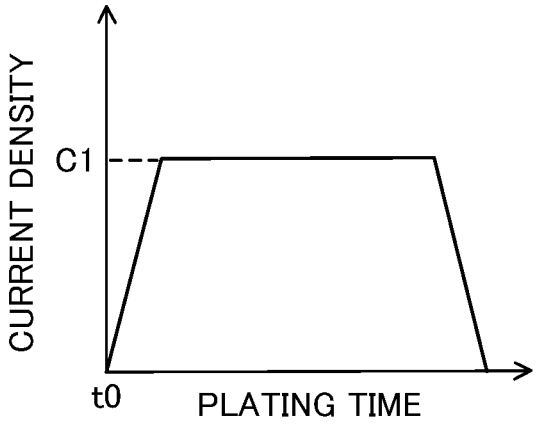
FIGS. 4A and 4B are profiles of examples of a current density provided for explaining control of a crystal grain size.
Figure 4B:
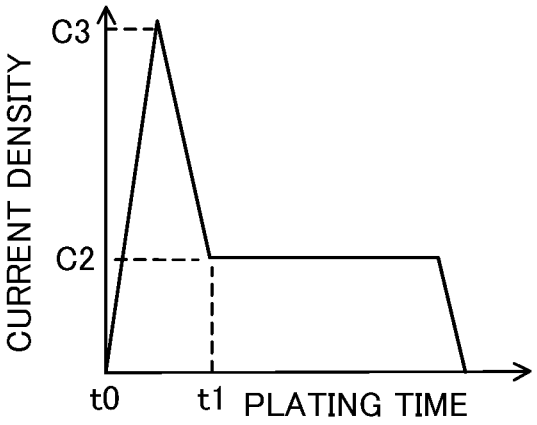

Generally, when the current density increases, a probability of occurrence of crystal nuclei increases. Therefore, the crystal grain size can be reduced. For example, as illustrated in FIG. 4A, it is assumed that a current density when the first layer 11 is plated be C1. As illustrated in FIG. 4B, it is assumed that a current density in an initial region when the second layer 12 is plated be C2 and a current density in a following region be C3.

At this time, the current density C1 of the first layer 11>the current density C3 in the following region of the second layer 12 is satisfied so that the average crystal grain size of the crystal grain 12*a* of the second layer 12 is larger than the average crystal grain size of the crystal grain 11*a* of the first layer 11.

Here, at an initial state of plating the second layer 12, the current density is set to the current density C3 larger than the current density C1 when the first layer 11 is plated (C3>C1) so that the intermediate layer 13 having the crystal grain 13*a* of which the average crystal grain size is smaller than the average crystal grain size of the crystal grain 11*a* of the first layer 11 is formed.

Then, the current density is set to the current density C2 at a time t1 after a predetermined period of time has elapsed so that the second layer 12 having the crystal grain 12*a* of which the average crystal grain size is larger than the average crystal grain size of the crystal grain 11*a* of the first layer 11 is formed.

Furthermore, a difference in contraction amounts is controlled by a ratio between the current density C1 and the current density C2 so as to suppress the warpage.

Figure 5A:
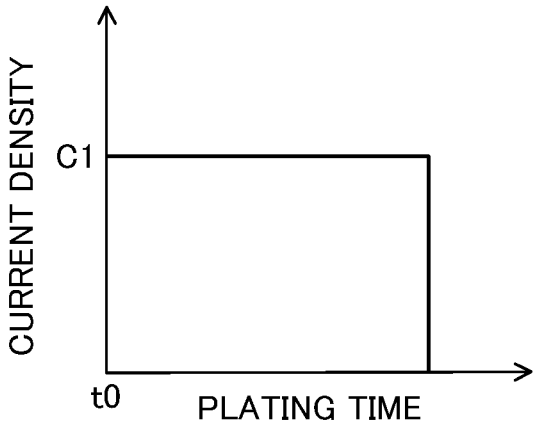
FIGS. 5A and 5B are profiles of other examples of the current density provided for explaining the control of the crystal grain size.
Figure 5B:
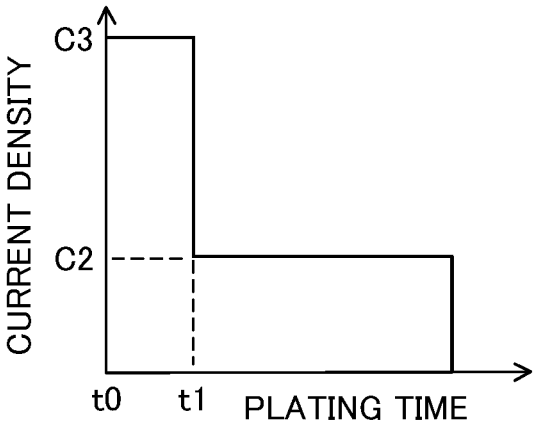

Here, a waveform until the current density reaches a desired current density may be a waveform that continuously reaches a target current density from a time t0 as illustrated in FIGS. 4A and 4B and may be a waveform that reaches a target current density in a stepwise manner at times t0 and t1 as illustrated in FIGS. 5A and 5B.

It is preferable that these current densities have this relationship relative to the film thickness direction, and input currents at the time of plating have the above relationships of C1, C2, and C3 so as to control the crystal grain size of each layer.

Figure 6:
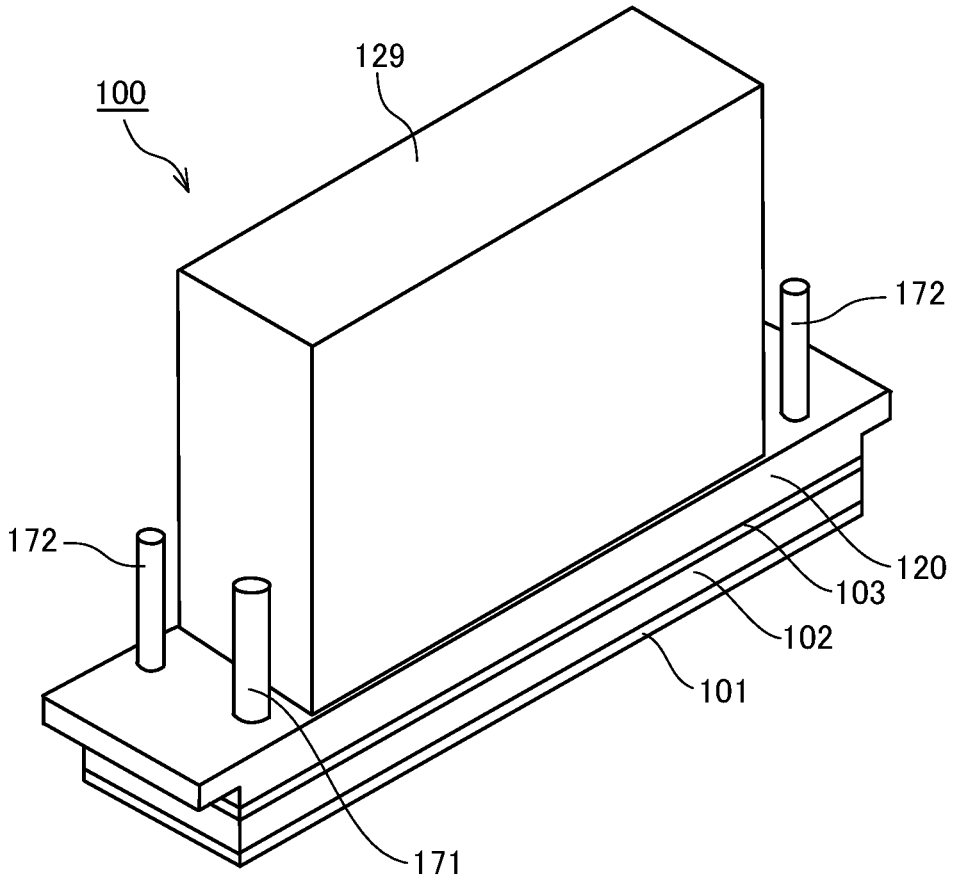
FIG. 6 is an external perspective view of an example of a liquid discharge head according to an embodiment of the present disclosure.
Figure 7:
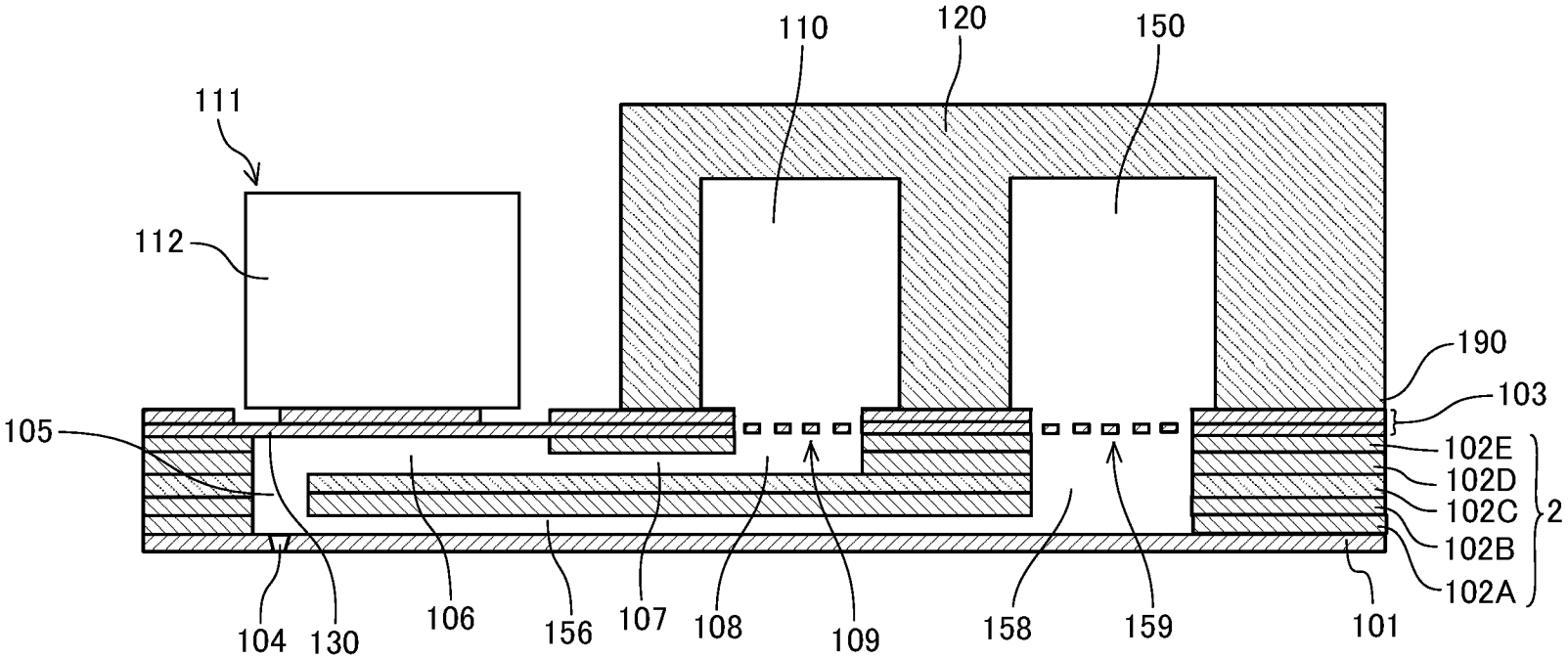
FIG. 7 is a cross-sectional explanatory view along a direction perpendicular to a nozzle arrangement direction of the head.

Next, an example of a liquid discharge head according to an embodiment of the present disclosure will be described referring to FIGS. 6 and 7. FIG. 6 is an external perspective explanatory view of the liquid discharge head, and FIG. 7 is a cross-sectional explanatory view along a direction perpendicular to a nozzle arrangement direction of the head.

In a liquid discharge head 100, a nozzle plate 101, a channel plate 102, and a head diaphragm substrate 103 including the metal member according to an embodiment of the present disclosure as a wall metal member are laminated and bonded. A piezoelectric actuator 111 which displaces a vibration region (diaphragm) 130 of the diaphragm substrate 103 and a common channel substrate 120 which also serves as a frame member of the head are included.

The nozzle plate 101 includes a plurality of nozzles 104 for discharging liquid.

The channel plate 102 forms a plurality of individual chambers 106 which communicates with the plurality of nozzles 104 via each nozzle communication channel 105, a plurality of supply-side fluid resistance portions 107 which respectively communicates with the plurality of individual chambers 106, and one or a plurality of supply-side liquid introduction portions 108 which communicates with one or more the supply-side fluid resistance portions 107.

The supply-side liquid introduction portion 108 communicates with a supply-side common channel 110 via a supply-side filter 109 provided in the diaphragm substrate 103. The channel plate 102 is formed by laminating a plurality of plate members 102A to 102E. However, the channel plate 102 is not limited to this.

The diaphragm substrate 103 includes the metal member 1 according to an embodiment of the present disclosure.

The diaphragm substrate 103 includes a deformable vibration region 130 forming a wall surface of the individual chamber 106 of the channel plate 102. Here, the diaphragm substrate 103 has a two-layer structure (not limited to this structure), and includes a first layer (first layer 11 of metal member 1) forming a thin portion from the side of the channel plate 102 and a second layer (second layer 12 including intermediate layer 13 of metal member 1) forming a thick portion. The deformable vibration region 130 is formed in a part corresponding to the individual chamber 106 of the first layer 11.

On the side of the diaphragm substrate 103 opposite to the individual chamber 106, the piezoelectric actuator 111 including an electromechanical conversion element as a driving unit (actuator and pressure generation unit) which deforms the vibration region 130 of the diaphragm substrate 103 is arranged.

In the piezoelectric actuator 111, grooves are processed in a piezoelectric member by half cut dicing to form a required number of columnar piezoelectric elements 112 in a comb-like shape at predetermined intervals. Then, the piezoelectric element 112 is bonded to the vibration region (diaphragm) 130 of the diaphragm substrate 103.

The channel plate 102 forms a plurality of individual collection channel 156 which is provided along a surface direction of the channel plate 102 and communicates with the plurality of individual chambers 106 via each nozzle communication channel 105 and one or a plurality of collection-side liquid introduction portions 158 which communicates with one or more individual collection channels 156. The collection-side liquid introduction portion 158 communicates with a collection-side common channel 150 via a collection-side filter 159 of the diaphragm substrate 103.

The common channel substrate 120 forms the supply-side common channel 110 which communicates with the supply-side liquid introduction portion 108 via the supply-side filter 109 and the collection-side common channel 150 which communicates with the collection-side liquid introduction portion 158 via the collection-side filter 159. The supply-side common channel 110 communicates with a supply port 171, and the collection-side common channel 150 communicates with a collection port 172.

In the liquid discharge head 100, for example, a voltage applied to the piezoelectric element 112 is lowered from a reference potential (intermediate potential) to contract the piezoelectric element 112, and the vibration region 130 of the diaphragm substrate 103 is pulled, so that a volume of the individual chamber 106 expands. Accordingly, liquid flows into the individual chamber 106.

Thereafter, a volume applied to the piezoelectric element 112 is increased to elongate the piezoelectric element 112 in a lamination direction, and the vibration region 130 of the diaphragm substrate 103 is deformed toward the nozzle 104 to contract the volume of the individual chamber 106. Accordingly, the liquid in the individual chamber 106 is pressurized, and the liquid is discharged from the nozzle 104.

Furthermore, the liquid which is not discharged from the nozzle 104 passes through the nozzle 104, is collected by the collection-side common channel 150 from the individual collection channel 156, and then, is supplied to the supply-side common channel 110 again from the collection-side common channel 150 via an external circulation path.

The head driving method is not limited to the above example (pull/push discharge/impact), and the head can be driven by pull-impact or push-impact according to the direction of the driving waveform.

In the liquid discharge head 100, the diaphragm substrate 103 includes the metal member 1 according to the first embodiment.

With this structure, if the vibration region 130 of the diaphragm substrate 103 is repeatedly vibrated (displacement), the delamination does not occur, and the liquid can be stably discharged.

Figure 8:
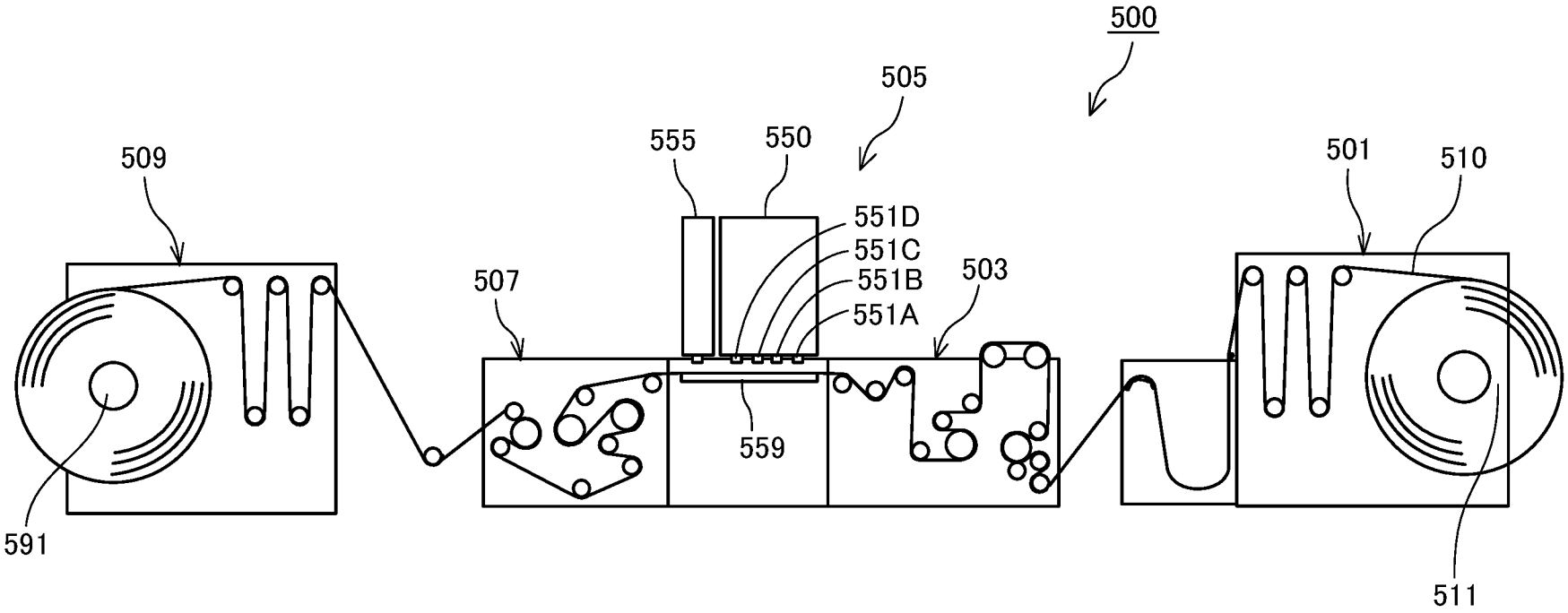
FIG. 8 is a schematic explanatory view of an example of a liquid discharge apparatus according to an embodiment of the present disclosure.
Figure 9:
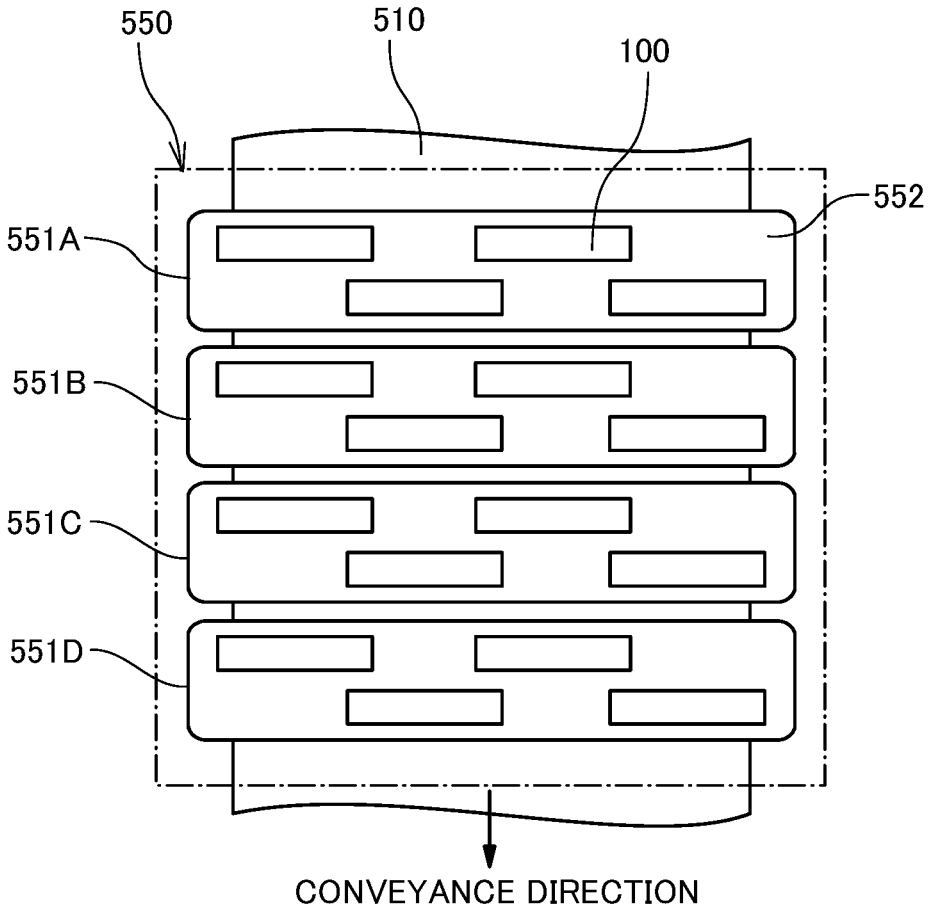
FIG. 9 is an explanatory plan view of an example of a head unit of the apparatus.

Next, an example of a liquid discharge apparatus according to an embodiment of the present disclosure will be described referring to FIGS. 8 and 9. FIG. 8 is a schematic explanatory view of the liquid discharge apparatus, and FIG. 9 is an explanatory plan view of an example of a head unit of the liquid discharge apparatus.

A printer 500 that is the liquid discharge apparatus includes a carrying unit 501 which carries a continuous body 510, a guide conveyer 503 which guides and conveys the continuous body 510 carried from the carrying unit 501 to a printing unit 505, the printing unit 505 which performs printing for discharging the liquid on the continuous body 510 and forming an image, a dryer 507 which dries the continuous body 510, a discharger 509 which discharges the continuous body 510, and the like.

The continuous body 510 is fed out from an original winding roller 511 of the carrying unit 501, is guided and conveyed by each roller of the carrying unit 501, the guide conveyer 503, the dryer 507, and the discharger 509, and is wound by a winding roller 591 of the discharger 509.

In the printing unit 505, the continuous body 510 is conveyed on a conveyance guide member 559 as facing head units 550 and 555, an image is formed by the liquid discharged from the head unit 550, and post-processing is executed by processing liquid discharged from the head unit 555.

Here, in the head unit 550, for example, four-color full-line head arrays 551A, 551B, 551C, and 551D (hereinafter, referred to as "head array 551" when colors are not distinguished from each other) are arranged from an upstream side of the conveyance direction.

Each head array 551 is a liquid discharger, and the head arrays 551 respectively discharge black K, cyan C, magenta M, and yellow Y liquid relative to the continuous body 510 to be conveyed. The kinds and the number of the colors are not limited to the above.

In the head array 551, for example, the liquid discharge heads (which is also simply referred to "head") 100 are arranged on a base substrate 552 in a zigzag manner. However, the structure of the head array 551 is not limited to this.

Figure 10:
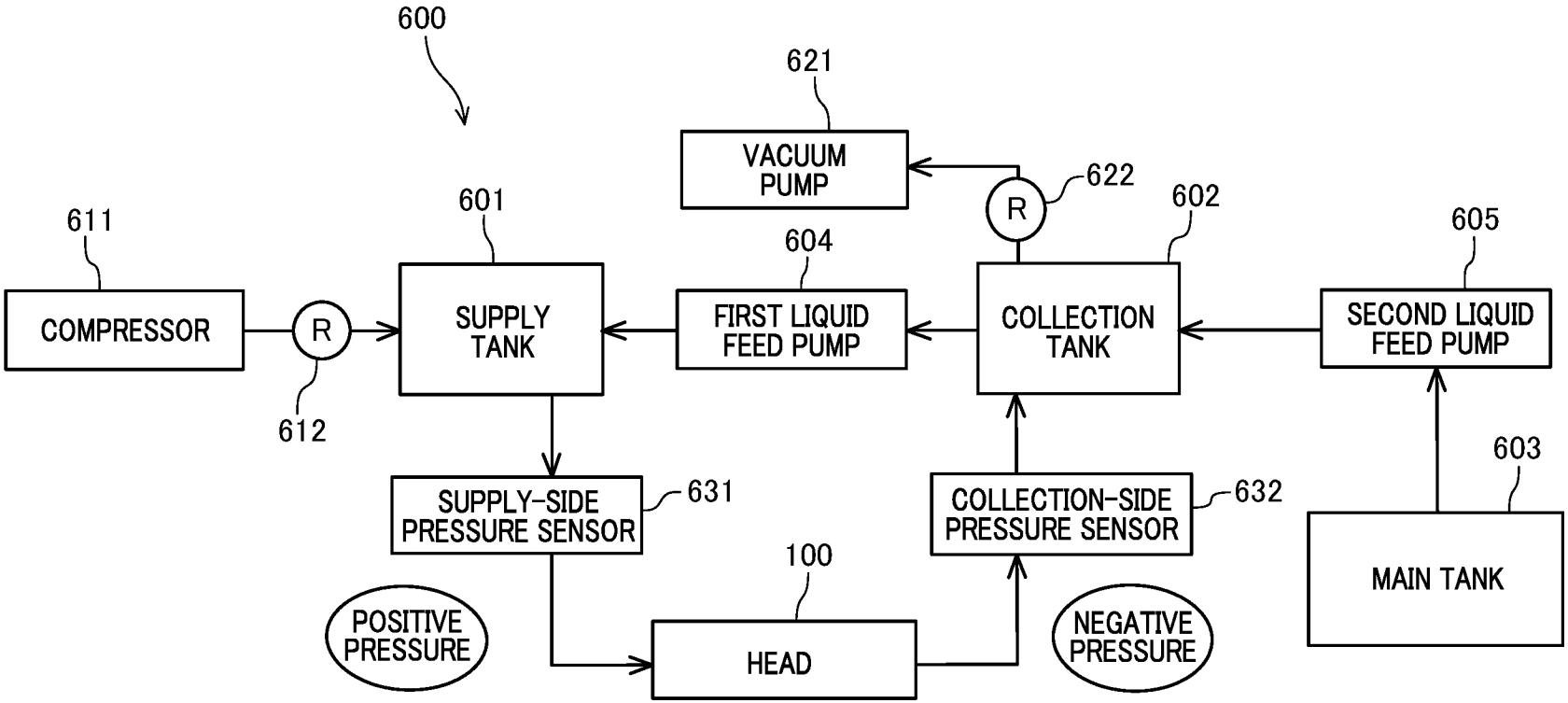
FIG. 10 is an explanatory block diagram of an example of a liquid circulation device.

Next, an example of a liquid circulation device will be described with reference to FIG. 10. FIG. 10 is an explanatory block diagram of the liquid circulation device. Here, a single head is illustrated. However, in a case where the plurality of heads is arranged, a supply-side liquid path and a collection-side liquid path are respectively connected to a supply side and a collection side of each of the plurality of heads via a manifold and the like.

A liquid circulation device 600 includes a supply tank 601, a collection tank 602, a main tank 603, a first liquid feed pump 604, a second liquid feed pump 605, a compressor 611, a regulator 612, a vacuum pump 621, a regulator 622, a supply-side pressure sensor 631, a collection-side pressure sensor 632, and the like.

Here, the compressor 611 and the vacuum pump 621 form a device which generates a difference between a pressure in the supply tank 601 and a pressure in the collection tank 602.

The supply-side pressure sensor 631 is connected to the supply-side liquid path which is provided between the supply tank 601 and the head 100 and is connected to the supply port 171 of the head 100. The collection-side pressure sensor 632 is connected between the head 100 and the collection tank 602 and to the collection-side liquid path connected to the collection port 172 of the head 100.

One side of the collection tank 602 is connected to the supply tank 601 via the first liquid feed pump 604, and another side of the collection tank 602 is connected to the main tank 603 via the second liquid feed pump 605.

With this structure, the circulation path is formed in which liquid flows from the supply tank 601 into the head 100 via the supply port 171, is collected from the collection port 172 to the collection tank 602, and is sent from the collection tank 602 to the supply tank 601 by the first liquid feed pump 604 to circulate the liquid.

Here, the supply tank 601 is connected to the compressor 611, and control is performed to detect a predetermined positive pressure by the supply-side pressure sensor 631. On the other hand, the collection tank 602 is connected to the vacuum pump 621, and control is performed to detect a predetermined negative pressure by the collection-side pressure sensor 632.

As a result, while the liquid is circulated through the head 100, a negative pressure of a meniscus can be maintained to be constant.

Furthermore, when liquid is discharged from the nozzle 104 of the head 100, amounts of liquid in the supply tank 601 and the collection tank 602 are reduced. Therefore, liquid is appropriately replenished from the main tank 603 to the collection tank 602 by using the second liquid feed pump 605.

A timing of replenishing the liquid from the main tank 603 to the collection tank 602 can be controlled according to a detection result of a liquid level sensor provided in the collection tank 602. For example, liquid is replenished when a liquid level of the liquid in the collection tank 602 falls below a predetermined height.

Figure 11:
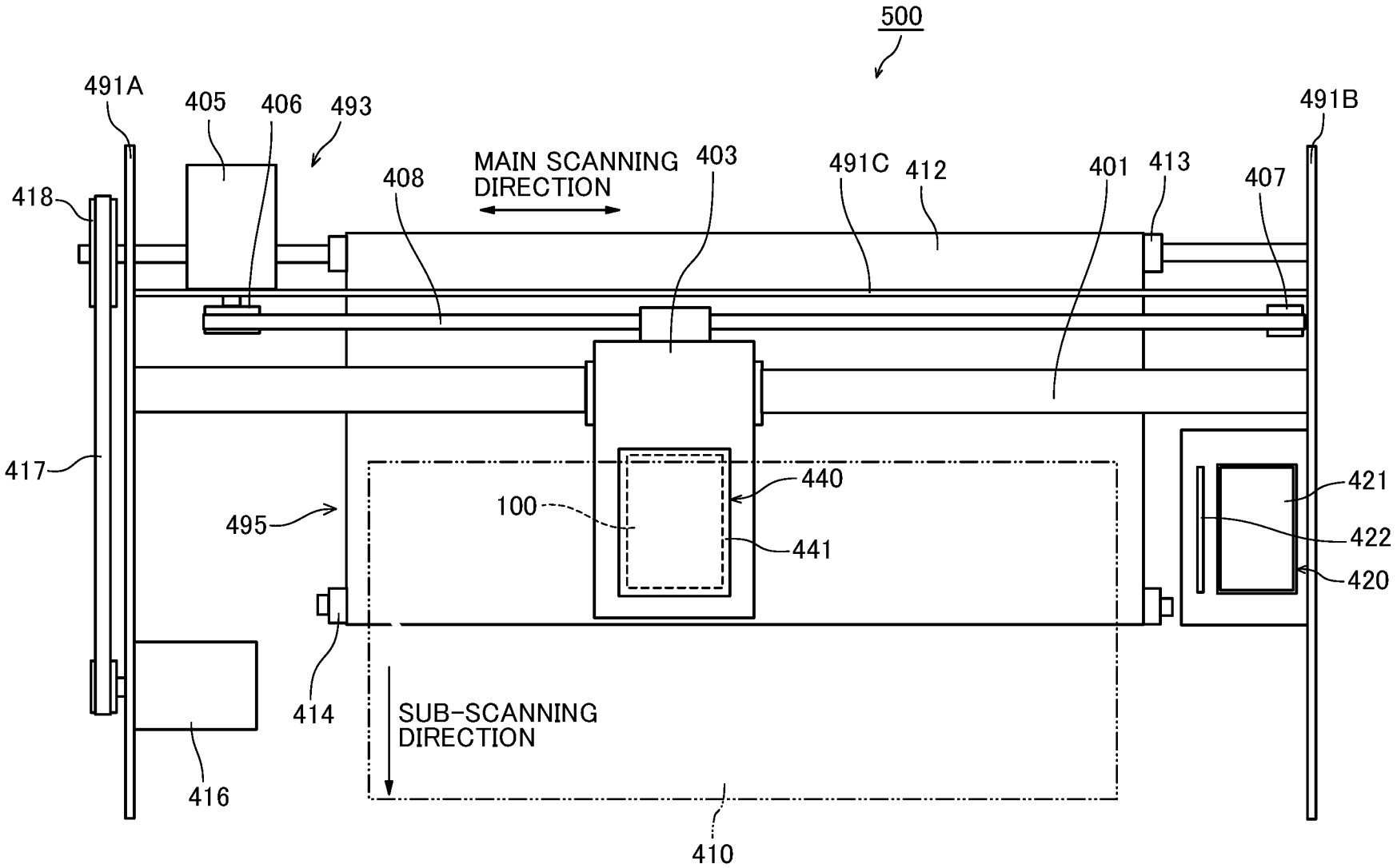
FIG. 11 is an explanatory plan view of a main part of another example of the liquid discharge apparatus according to an embodiment of the present disclosure.
Figure 12:
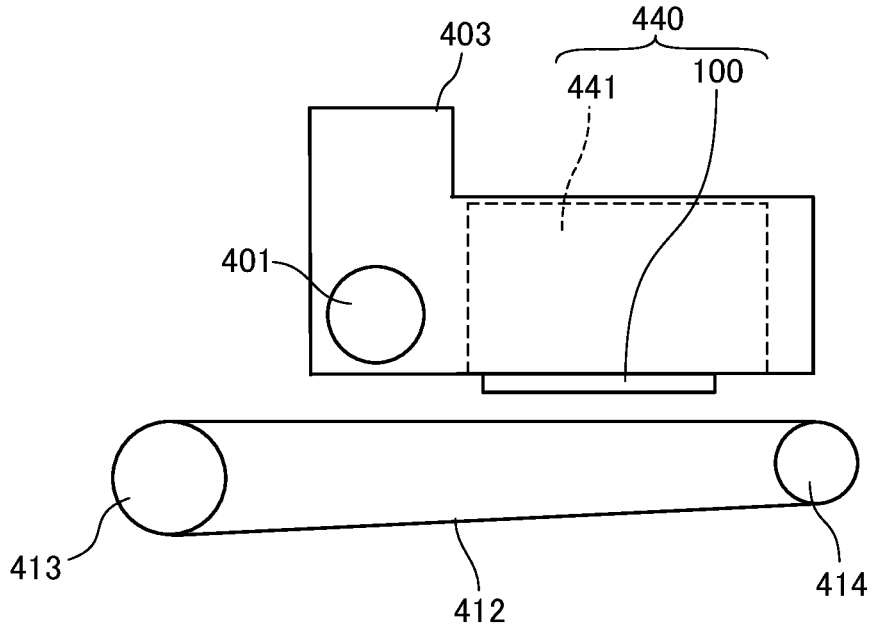
FIG. 12 is an explanatory side view of the main part of the apparatus.

Next, another example of the printer as the liquid discharge apparatus according to an embodiment of the present disclosure will be described referring to FIGS. 11 and 12. FIG. 11 is an explanatory plan view of a main part of the printer, and FIG. 12 is an explanatory side view of the main part of the printer.

The printer 500 is a serial type apparatus, and a carriage 403 reciprocates in the main scanning direction by a main scanning movement mechanism 493. The main scanning movement mechanism 493 includes a guide member 401, a main scanning motor 405, a timing belt 408, and the like. The guide member 401 is stretched between left and right side plates 491A and 491B and movably holds the carriage 403. The carriage 403 is reciprocated in the main scanning direction by the main scanning motor 405 via the timing belt 408 stretched between a driving pulley 406 and a driven pulley 407.

On the carriage 403, a liquid discharge device 440 in which the liquid discharge head 100 according to the present embodiment and a head tank 441 are integrated is mounted. The liquid discharge head 100 of the liquid discharge device 440 discharges liquid of each color, for example, yellow (Y), cyan (C), magenta (M), and black (K). Furthermore, in the liquid discharge head 100, a nozzle line including the plurality of nozzles is arranged in a sub-scanning direction perpendicular to the main scanning direction, and the nozzles are attached so as to discharge the liquid downward.

The liquid discharge head 100 is connected to the liquid circulation device 600 described above, and liquid of a required color is circulated and supplied to the liquid discharge head 100.

The printer 500 includes a conveyance mechanism 495 which conveys a paper sheet 410. The conveyance mechanism 495 includes a conveyance belt 412 which is a conveyer and a sub-scanning motor 416 which drives the conveyance belt 412.

The conveyance belt 412 attracts the paper sheet 410 and conveys the paper sheet 410 at a position facing the liquid discharge head 100. The conveyance belt 412 is an endless belt and is stretched between a conveyance roller 413 and a tension roller 414. The paper sheet 410 can be attracted by electrostatic attraction or air suction.

Then, the conveyance roller 413 is rotated and driven by the sub-scanning motor 416 via a timing belt 417 and a timing pulley 418 so that the conveyance belt 412 rotates and moves in the sub-scanning direction.

In addition, on one side of the carriage 403 in the main scanning direction, a maintenance and recovery mechanism 420 which maintains and recovers the liquid discharge head 100 is arranged on the side of the conveyance belt 412.

The maintenance and recovery mechanism 420 includes, for example, a cap member 421 which caps a nozzle surface (surface where nozzle is formed) of the liquid discharge head 100 and a wiper member 422 which wipes the nozzle surface.

The main scanning movement mechanism 493, the maintenance and recovery mechanism 420, and the conveyance mechanism 495 are attached to a casing including the side plates 491A and 491B and a back plate 491C.

In the printer 500 configured in this way, the paper sheet 410 is fed on the conveyance belt 412 and attracted, and conveyed in the sub-scanning direction by the rotation movement of the conveyance belt 412.

Therefore, by driving the liquid discharge head 100 in response to an image signal while moving the carriage 403 in the main scanning direction, the liquid is discharged on the stopped paper sheet 410 to form an image.

In this way, since the printer 500 includes the liquid discharge head according to the present embodiment, high-quality images can be stably formed.

Figure 13:
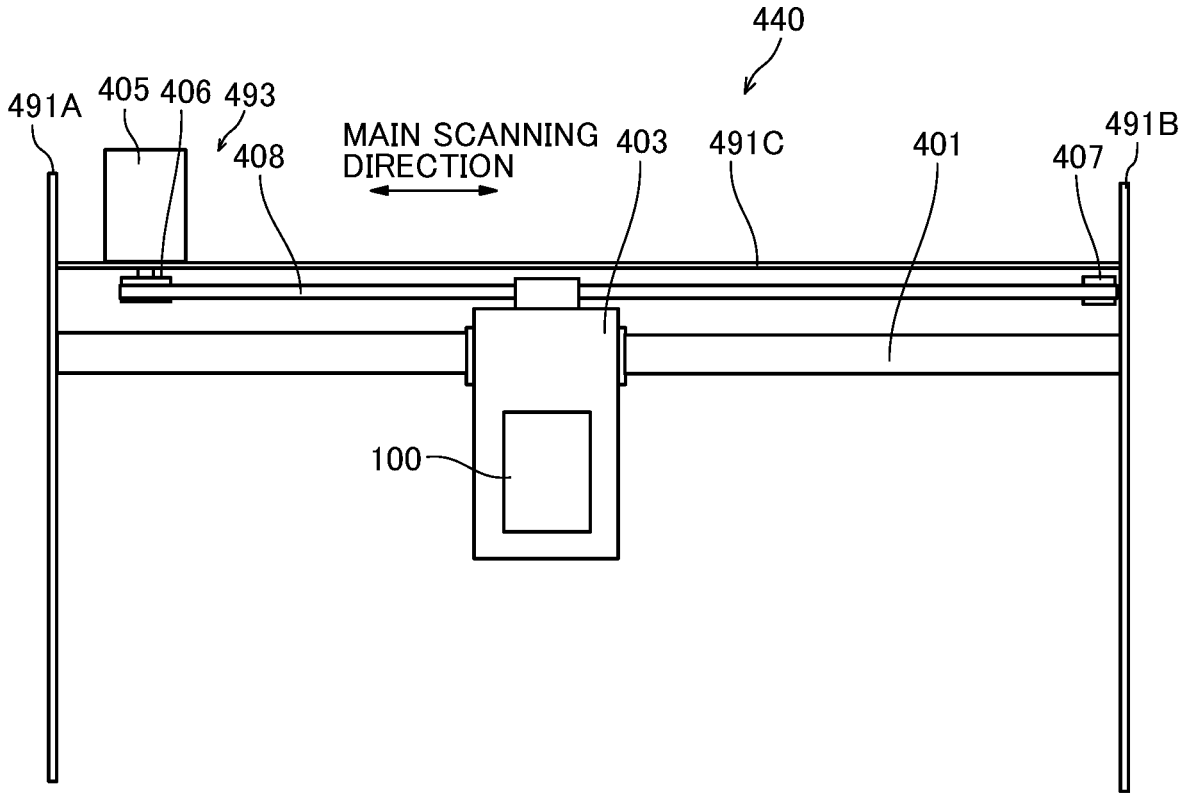
FIG. 13 is an explanatory plan view of a main part of another example of the liquid discharge device according to an embodiment of the present disclosure.

Next, another example of the liquid discharge device according to an embodiment of the present disclosure will be described with referring to FIG. 13. FIG. 13 is an explanatory plan view of a main part of the liquid discharge device.

The liquid discharge device 440 includes a casing portion including the side plates 491A and 491B and the back plate 491C, the main scanning movement mechanism 493, the carriage 403, and the liquid discharge head 100 of members included in the liquid discharge apparatus.

A liquid discharge device in which the maintenance and recovery mechanism 420 described above is further attached to, for example, the side plate 491B of the liquid discharge device 440 can be formed.

Figure 14:
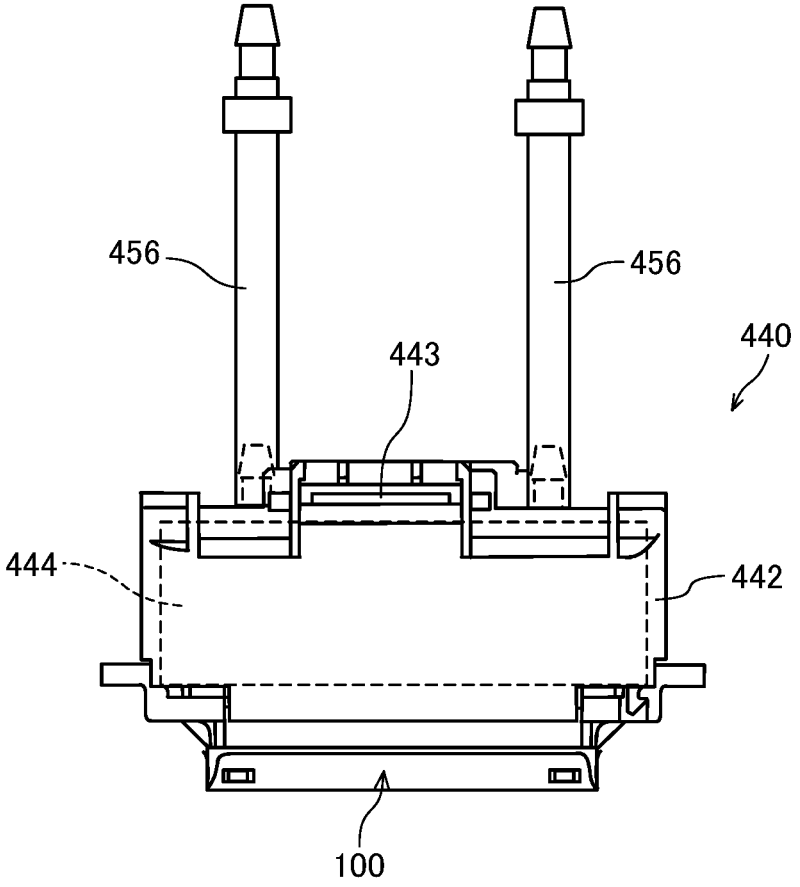
FIG. 14 is a front explanatory view of still another example of the liquid discharge device according to an embodiment of the present disclosure.

Next, still another example of the liquid discharge device according to an embodiment of the present disclosure will be described referring to FIG. 14. FIG. 14 is a front explanatory view of the liquid discharge device.

The liquid discharge device 440 includes the liquid discharge head 100 to which a channel component 444 is attached and a tube 456 connected to the channel component 444.

The channel component 444 is arranged in a cover 442. The head tank 441 can be included instead of the channel component 444. A connector 443 which is electrically connected to the liquid discharge head 100 is provided above the channel component 444.

In the present application, the liquid discharged from the liquid discharge head is preferably liquid having viscosity and surface tension which can be discharged from the head and is not particularly limited. However, liquid is preferable which has a viscosity which becomes equal to or less than 30 mPa·s under an ordinary temperature and a normal pressure or by being heated or cooled. More specifically, the liquid includes solution, suspension liquid, an emulsion, and the like including a solvent such as water or an organic solvent, a coloring agent such as a dye or a pigment, a functionalizing material such as a polymerizable compound, a resin or a surfactant, a biocompatible material such as deoxyribonucleic acid (DNA), an amino acid, a protein, calcium, and the like, an edible material such as a natural colorant, and the like. For example, these kinds of liquid can be used for inkjet ink, surface treatment liquid, liquid for forming a component such as an electronic element and a light emitting element and an electronic circuit resist pattern, material liquid for three-dimensional shaping, and the like.

An energy generation source for discharging the liquid includes a device using a piezoelectric actuator (laminated-type piezoelectric element and thin-film piezoelectric element), a thermal actuator using an electrothermal conversion element such as a heating resistor, an electrostatic actuator including a diaphragm and a counter electrode, and the like.

The "liquid discharge device" is a device in which functional components and mechanisms are integrated with the liquid discharge head and includes a group of components related to discharge of liquid. For example, the "liquid discharge device" includes a device obtained by combining at least one of the head tank, the carriage, the supply mechanism, the maintenance and recovery mechanism, the main scanning movement mechanism, and the liquid circulation device with the liquid discharge head.

Here, the integration means, for example, to secure the liquid discharge head with the functional components and mechanisms by fastening, adhesion, engagement, and the like and to movably hold one of the components relative to the other component. Furthermore, the liquid discharge head and the functional components and mechanisms may be formed to be detachable from each other.

For example, as the liquid discharge device, there is a device in which the liquid discharge head and the head tank are integrated. Furthermore, there is a device in which the liquid discharge head and the head tank are integrated with each other by being connected with the tube and the like. Here, a device including a filter between the head tank and the liquid discharge head in the liquid discharge device can be added.

In addition, there is a liquid discharge device in which the liquid discharge head and the carriage are integrated with each other.

There is a liquid discharge device in which a guide member forming a part of a scanning movement mechanism movably holds the liquid discharge head and the scanning movement mechanism and the liquid discharge head are integrated with each other. There is a liquid discharge device in which the liquid discharge head, the carriage, and the main scanning movement mechanism are integrated.

In addition, there is a liquid discharge device in which the cap member which is a part of the maintenance and recovery mechanism is secured to the carriage to which the liquid discharge head is attached to integrate the liquid discharge head, the carriage, and the maintenance and recovery mechanism.

Furthermore, as the liquid discharge device, there is a liquid discharge device in which the tube is connected to the liquid discharge head to which the head tank or the channel component is attached to integrate the liquid discharge head with the supply mechanism. The liquid in a liquid storage source is supplied to the liquid discharge head via the tube.

It is assumed that the main scanning movement mechanism include a single guide member. It is assumed that the supply mechanism include a single tube and a single loading unit.

The "liquid discharge apparatus" includes an apparatus which includes the liquid discharge head or the liquid discharge device and drives the liquid discharge head to make the liquid discharge head discharge liquid. The liquid discharge apparatus includes not only an apparatus which can discharge liquid to an object to which liquid can be attached but also an apparatus for discharging liquid toward air and liquid.

Furthermore, the "liquid discharge apparatus" can include a device for feeding, conveying, and ejecting an object to which liquid can be attached, and in addition, can include a preprocessing device, a post-processing device, and the like.

For example, the "liquid discharge apparatus" is an image forming apparatus which is an apparatus for discharging ink to form an image on a paper sheet and a three-dimensional fabrication apparatus for discharging fabrication liquid to a powder layer formed by processing powder in a layer shape so as to fabricate a three dimensional object.

Furthermore, the "liquid discharge apparatus" is not limited to an apparatus which visualizes an image having meaning such as letters and figures by the discharged liquid. For example, an apparatus which forms a pattern having no meaning and an apparatus which forms a three-dimensional image are included.

The "object to which the liquid can be attached" means an object to which liquid can be temporarily attached, and includes an object to which liquid is attached and adhered, an object to which liquid is attached and permeated, and the like. Specific examples include recorded media such as a paper sheet, recording paper, a recording paper sheet, a film, and cloth, an electronic component such as an electronic substrate and a piezoelectric element, and media such as a powder layer, an organ model, and an inspection cell, and include all objects to which liquid can be attached unless otherwise limited.

The material of the "object to which liquid can be attached" may be paper, thread, fiber, cloth, leather, metal, plastic, glass, wood, ceramics, and the like to which liquid can be temporarily attached.

In addition, there is the "liquid discharge apparatus" in which the liquid discharge head and the object to which liquid can be attached are relatively moved. However, the liquid discharge apparatus is not limited to this. As a specific example, a serial type apparatus for moving the liquid discharge head and a line type apparatus which does not move the liquid discharge head are included.

In addition, the "liquid discharge apparatus" includes a processing liquid applying apparatus which discharges processing liquid to a paper sheet to apply the processing liquid on the surface of the paper sheet for the purpose of improving the quality of the surface of the paper sheet, an injection granulation apparatus which injects composition liquid obtained by dispersing a raw material into solution via a nozzle and granulates fine particles of the raw material, and the like.

Herein, it is assumed that image formation, recording, printing letters, copying, printing, fabrication, and the like be all synonymous.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A metal member, comprising:

a first layer;

a second layer having a second average crystal grain size different from a first average crystal grain size of the first layer; and an intermediate layer having an average crystal grain size smaller than both the first average crystal grain size and the second average crystal grain size, and being interposed between the first layer and the second layer, wherein the second layer and the intermediate layer are electroformed from identical material using different current densities so that the average crystal grain size of the intermediate layer is smaller than the second average crystal grain size.

2. The metal member according to claim 1, wherein the second average crystal grain size of the second layer is larger than the first average crystal grain size of the first layer.

3. The metal member according to claim 1, wherein a thickness of the intermediate layer is thinner than both a thickness of the first layer and a thickness of the second layer.

4. A head diaphragm substrate comprising:

the metal member according to claim 1.

5. A liquid discharge head comprising:

the head diaphragm substrate according to claim 4.

6. A liquid discharge device comprising:

the liquid discharge head according to claim 5.

7. The liquid discharge device according to claim 6, further comprising at least one of a head tank that stores liquid to be supplied to the liquid discharge head, a carriage that mounts the liquid discharge head, a supply mechanism that supplies liquid to the liquid discharge head, a maintenance and recovery mechanism that maintains and recovers the liquid discharge head, and a main scanning movement mechanism that moves the liquid discharge head in a main scanning direction integrated with the liquid discharge head.

8. A liquid discharge apparatus comprising:

the liquid discharge device according to claim 6.

9. A liquid discharge apparatus comprising:

the liquid discharge head according to claim 5.

10. The metal member of claim 1, wherein the average crystal grain size of the intermediate layer is such that crystal grains of the intermediate layer enter between crystal grains of the first and second layers to improve adhesion between the first and second layers.

11. The liquid discharge head of claim 5, further comprising a piezoelectric actuator on a side of the second layer of the metal member, wherein the second average crystal grain size of the second layer is larger than the first average crystal gain size of the first layer.

12. The metal member of claim 1, wherein a combined thickness of the second layer and the intermediate layer is greater than a thickness of the first layer.

13. The liquid discharge head of claim 5, wherein a combined thickness of the second layer and the intermediate layer is greater than a thickness of the first layer.

14. The metal member of claim 1, wherein each of the first and second layer is a metal formed by electroforming.

15. A metal member, comprising:

a first layer;

a second layer having a second average crystal grain size larger than a first average crystal grain size of the first layer; and an intermediate layer having an average crystal grain size smaller than both the first average crystal grain size and the second average crystal grain size, and being interposed between the first layer and the second layer, wherein the intermediate layer is thinner than both the first layer and the second layer, and wherein the second layer and the intermediate layer are electroformed from identical material using different current densities so that the average crystal grain size of the intermediate layer is smaller than the second average crystal grain size.

16. A metal member, comprising:

a first layer;

a second layer; and an intermediate layer having an average crystal grain size smaller than both a first average crystal grain size of the first layer and a second average crystal grain size of the second layer, and being interposed between the first layer d the second layer, wherein the intermediate layer is thinner than both the first layer and the second layer, and wherein the second layer and the intermediate layer are electroformed from identical material using different current densities so that the average crystal grain size of the intermediate layer is smaller than the second average crystal grain size.

17. The metal member of claim 1, wherein the metal member consists of only the first layer, the second layer, and the intermediate layer.

18. The metal member of claim 1, wherein the first layer is electroformed from the identical material of the second layer and the intermediate layer using a first current density different from the current densities used to electroform the second layer and the intermediate layer.

* * * * *